United States Patent [19]

List

[11] 4,103,835

[45] Aug. 1, 1978

[54] STRAND WINDING APPARATUS

[75] Inventor: Ralph W. List, East Lansdowne, Pa.

[73] Assignee: Techniservice Division, Textured Yarn Co., Inc., Kennett Square, Pa.

[21] Appl. No.: 719,277

[22] Filed: Aug. 31, 1976

[51] Int. Cl.[2] ..... B65H 54/02; B65H 67/04

[52] U.S. Cl. ..... 242/18 A; 242/18 PW; 242/19

[58] Field of Search ..... 242/18 A, 18 PW, 25 A, 242/125.1, 19, 48

[56] References Cited

U.S. PATENT DOCUMENTS

| | | | |
|---|---|---|---|
| 2,296,339 | 9/1942 | Daniels | 242/18 A |
| 3,813,050 | 5/1974 | Landwehrkamp | 242/18 A |
| 3,936,006 | 2/1976 | List et al. | 242/18 A |

*Primary Examiner*—Stanley N. Gilreath
*Attorney, Agent, or Firm*—Miller & Prestia

[57] ABSTRACT

Textile strands are transferred from a full package to an empty bobbin spaced endwise therefrom, by delaying traverse of the winding strand and by picking up the strand and forming a resulting transfer tail on the end of the empty bobbin.

The pickup step utilizes rotary bristles located at the spaced adjacent ends of spindles for the respective packages.

The transfer delay step may utilize a bistable inertial device positioned to intercept the transferring strand, and functioning to release the strand after a momentary delay, after which delay the strand is wound onto the empty bobbin to begin the formation of a package.

The inertial device has adjustable ears and includes variable weights serving to vary the timing delay, whereby the length and position of the transfer tail may be controlled and adjusted. It also has a specially tapered structure so that even if transfer is attempted while the device is positioned out of phase, the yarn will nevertheless reposition the device in phase to actuate the delay function.

5 Claims, 11 Drawing Figures

FIG. 1.
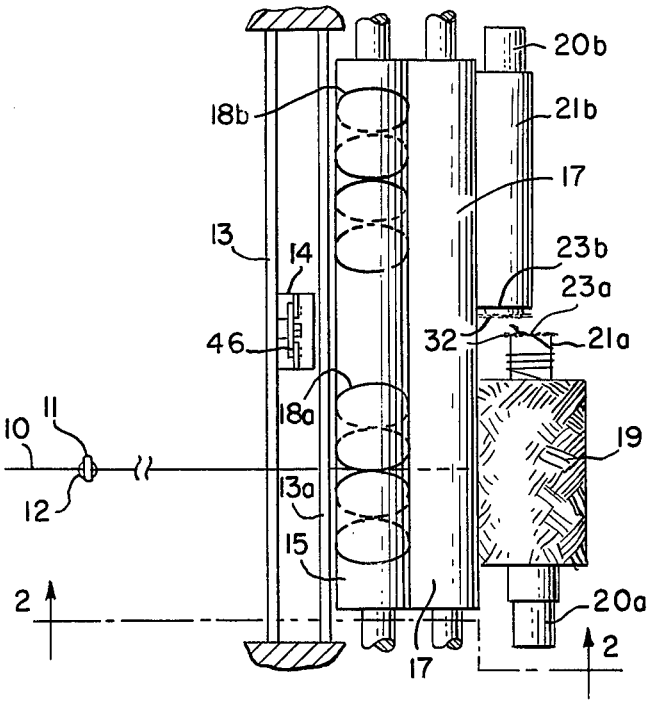
FIG. 3.
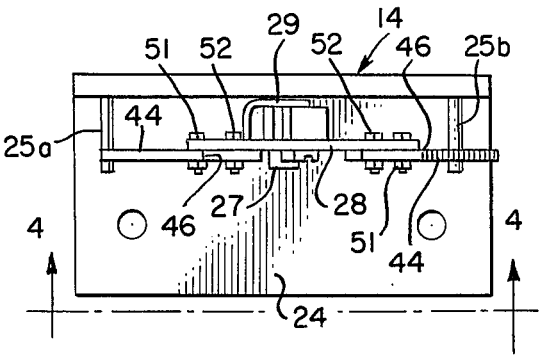
FIG. 4.
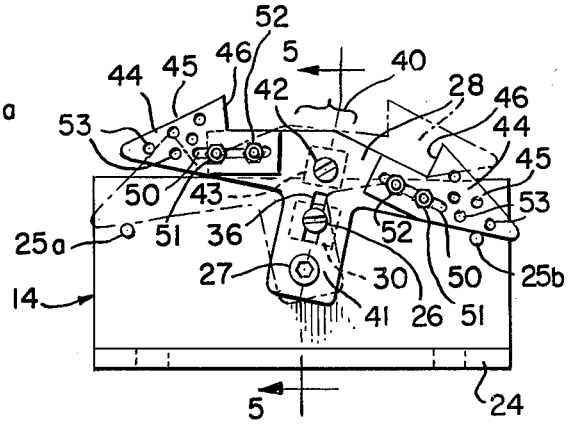
FIG. 2.
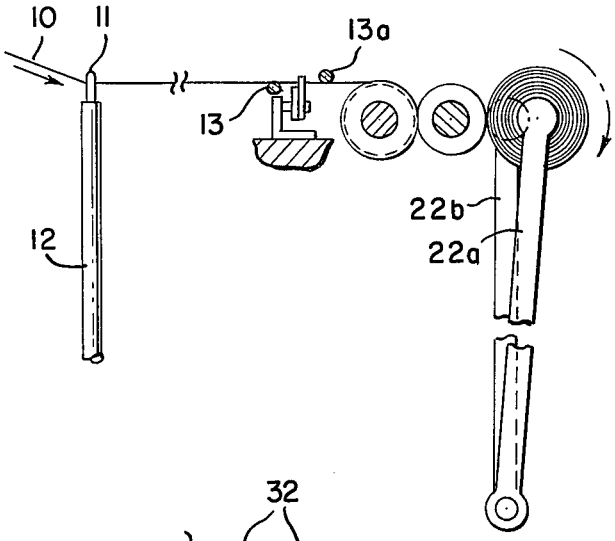
FIG. 5.
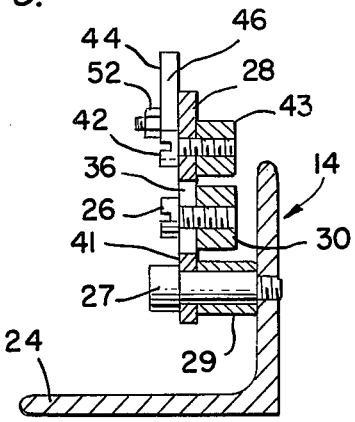
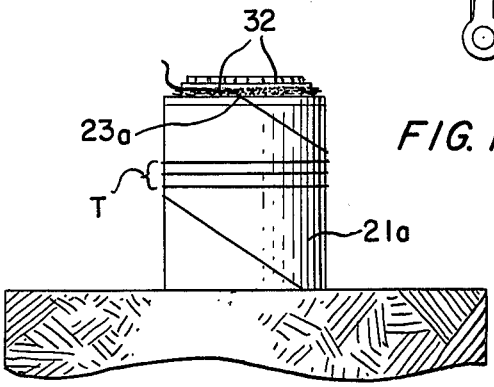
FIG. 11

STRAND WINDING APPARATUS

BRIEF DESCRIPTION OF THE INVENTION

This invention relates to package winding of textile strands uninterrupted by transfer from a full package to an empty bobbin, and relates particularly to automatic formation of an accurately positioned transfer tail of controllable length as each new package beings to form.

In many textile operations utilizing yarn or other strands it is advantageous to interconnect a multiplicity of strand packages so that upon emptying each package the strand is automatically taken from a succeeding package. For this purpose, each package is provided with a transfer tail, preferably of uniform length and positioned at a uniform distance from the end of the package. To set up a magazining operation of the type discussed, each transfer tail is simply spliced or otherwise secured to the free end of the strand on the succeeding package.

The invention further relates to a transfer tail forming device which includes means for delaying the strand in transit from the full package to the one being started, and during that delay positioning the strand in a controlled manner capable of predetermining the formation and characteristics of the strand transfer tail.

PRIOR ART

Modern machinery for package winding of textile strands usually provides for transfer of the strand being wound from one package to an adjacent package, all without interruption in the winding operation. This enables a full package to be doffed while the strand is being wound onto a new package. Various arrangements are known for automatic strand transfer from one package to another, but so far as transfer tail formation is provided, the devices suggested are complicated, expensive, and difficult to adjust and maintain. Malfunction of automatic transfer from a full package to an empty bobbin is wasteful and may necessitate shutting down the winding machine—an added unproductive expense.

The patent to List et al U.S. Pat. No. 3,936,006, commonly assigned herewith, discloses a means for effecting strand transfer, utilizing a bistable inertial device for delaying the yarn in transit, and utilizing pickup discs as strand pickup devices at adjacent ends of spindles. Although a transfer tail is formed at random by the devices shown in the patent, the tail is randomly anchored on the empty bobbin. The devices are not directed to the problem of forming strand transfer tails for subsequent magazining operations whereby the length and position of the transfer tail may be controlled and adjusted. Nor do they possess other advantages that are achieved by this invention, as will further appear hereinafter.

The U.S. Pat. No. 3,345,003, to Mattingly et al granted Oct. 3, 1967 describes automatic transfer of yarn from a full bobbin to an empty bobbin, including means causing the yarn to cling or become anchored to one of the bobbins. Again, the thrust of the Mattingly et al disclosure is to anchor the yarn, but not to form a uniform length tail, accurately positioned for subsequent magazining. Mattingly et al prefer and describe a castellated ring, but they state that bristles, hooks or other projections may be used for this purpose. As in the List U.S. Pat. No. 3,936,006, no means is described whereby an accurately dimensioned and positioned transfer tail is formed, or how the length or position of any transfer tail could be controlled or adjusted.

It is accordingly highly advantageous to form strand packages with accurately dimensioned and positioned strand transfer tails, so that in the subsequent usage of the packages a plurality of packages may be linked together splicing or otherwise, for automatic continuous yarn feed from package to package in a magazining operation.

OBJECTS OF THE INVENTION

It is accordingly an object of this invention to form a transfer tail efficiently and uniformly during transfer of a winding strand from one package to another while maintaining continuity of winding.

Another object of this invention is to provide means for capturing the strand automatically to form an accurately positioned transfer tail of strand being transferred from a full package to an empty bobbin without interrupting the winding operation.

Further objects are to provide for controlled positioning of the strand transfer tail on the empty bobbin, and to provide for automatic breaking or severing of the strand between the packages after the strand has been anchored on the empty bobbin during such transfer.

Still another object is to provide for the automatic and adjustable delay of the strand movement during such transfer, and to provide a delay means which is shiftable between spaced-apart limiting positions in phase with yarn shifting movement from a full package to an empty bobbin, and which is self-correcting even when (because of malfunction or maladjustment) it is initially set up in a position which is out of phase with the yarn movement.

Other objects of the present invention, together with means and methods of attaining the various objects, will be apparent from the following description and the accompanying drawings of a preferred embodiment, which are presented by way of example rather than limitation.

DRAWINGS

FIG. 1 is a plan view of strand-winding apparatus according to this invention;

FIG. 2 is an end elevation of the same apparatus, taken at II—II on FIG. 1;

FIG. 3 is a plan view, on an enlarged scale, of an apparatus component shown in the preceding views;

FIG. 4 is a front elevation of the apparatus of FIG. 3, taken at IV—IV thereon;

FIG. 5 is a side sectional elevation of the apparatus of FIGS. 3 and 4, taken at V—V on FIG. 4;

FIG. 11 is an enlarged fragmentary view of a tail portion wound upon a bobbin as in FIG. 9.

DETAILED DESCRIPTION OF SPECIFIC EMBODIMENTS

Figure 6:
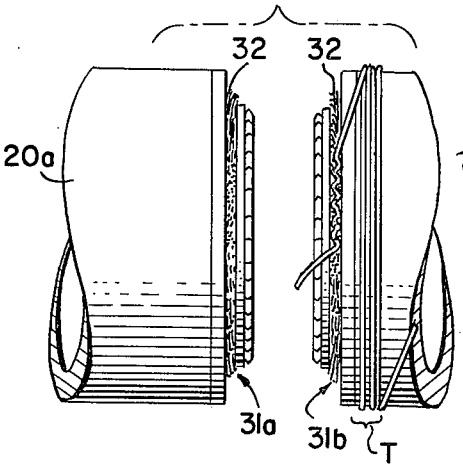
FIG. 6 is a fragmentary enlarged view in either plan or elevation, of adjacent apparatus components shown in FIGS. 1 and 2.

This invention provides an apparatus for uninterrupted package winding of textile strands including transfer from a full package to an empty bobbin substantially axially spaced therefrom, and automatic formation of a transfer tail of predetermined length and location upon the empty bobbin. As will be apparent hereinafter, such apparatus comprises a strand guide which is movable back and forth between extended lateral bisectors of the packages, a novel form of inertial flip-flop device located between the respective extended lateral bisectors and adapted to be contacted by the laterally transferring strand as the strand guide is transferred from one extended lateral bisector to the other and thereby to delay the lateral transfer of the strand momentarily in alignment with a marginal portion of the empty bobbin. This delay allows the strand to be caught to form a tail on the empty bobbin before traversing the strand and winding it to form another package. The tail forming combination includes strand trapping bristles substantially radially arranged for catching the strand during transfer, and delay and positioning means for forming it into a transfer tail, of predetermined length and position on the bobbin, and for engaging and gripping the strand and winding it to form the package after the transfer tail has been positioned and formed.

The various views of the appended drawings illustrate the features of strand catching and tail forming apparatus to which this invention is directed, without showing conventional driving, guiding, supporting, and supply elements, which are well known of themselves. Details of single-position package winding using a slotted traverse roll and an intermediate roll may be found in U.S. Pat. No. 3,374,960, the disclosure of which is incorporated herein by reference.

Although specific terms will be used in the description of specific forms of the apparatus which have been selected for illustration in the drawings, it will be appreciated that these terms are used for the sake of convenience and clarity of description of these specific forms of the invention, and are not intended to define or to limit the scope of the invention, which is defined in the appended claims.

It will be appreciated that the word "bobbin" as used herein is intended to be used generically herein to cover bobbins, pirns and all other equivalent articles used as a base for the winding of yarns or other strands thereon, to form a yarn package.

FIG. 1 shows in plan, and FIG. 2 in side elevation, apparatus of this invention with filling and empty winding positions and strand being wound at the filling position. Strand 10 proceeds from a source (not shown) at the left of FIG. 1 and FIG. 2 as indicated by arrows. The strand proceeds through the eye of a reciprocable eye guide 11, over guide bar 13, under guide bar 13(*a*), into and through a slot in the surface of helically slotted traverse roll 15, under intermediate roll 17, and onto winding package 19—shown at an intermediate stage between empty and full.

Package 19 comprises bobbin 21(*a*) on spindle 20(*a*) supported on swing arm 22(*a*). Swing arm 22(*b*) (FIG. 2) supports spindle 20(*b*), which carries empty bobbin 21(*b*). Traverse roll 15 has a pair of helical traverse slot patterns 18(*a*) and 18(*b*), one centered relative to bobbin 21(*a*) and the other centered relative to bobbin 21(*b*). Eye guide 11 is at the end of guide rod 12, which is shown located on the lateral bisector of package 19, midway of traverse pattern 18(*a*); when it is desired to perform the strand transfer operation the eye guide 11 is relocated so that it is positioned on the lateral bisector of the package to be formed on the empty bobbin 21(*b*), as shown in a later view. Also visible in FIG. 1 are strand catching devices 23(*a*) and 23(*b*) which carry a plurality of bristles as will further be described in detail hereinafter, and which are important features of this invention. The strand catching devices 23(*a*) and 23(*b*) are carried on adjacent ends of the respective bobbin spindles. Also visible in FIGS. 1 and 2 is a lateral transfer delay device 14, located midway from side to side and between guide rods 13 and 13(*a*), described in further detail hereinafter.

FIGS. 3, 4 and 5 show bistable inertial delay device 14 in plan and in front and side elevation, including mounting bracket 24 having a base with holes therein to receive suitable mounting means, and an upright part furnished with stop pins 25(*a*) and 25(*b*) at the left and right. Pivot pin 27 is threaded horizontally into the lower part of the upright, on a vertical center line. Washer 29 on the latter pin is located between the bracket upright and the base portion of a generally T-shaped flip-flop device 28 pivotally supported at its base on the pivot pin. Also vertically aligned is a slot 36 with retaining pin 26 extending therethrough and into a threaded bore in weight 30 retained thereby at adjustable height above the pivot pin.

The arms of the flip-flop device 28 extend outwardly in a T-shaped configuration to such an extent that, when the flip-flop device 28 is tilted against a stop pin at one side, its arm on the opposite side is at a strand-engaging height, while the arm on the near side is below such height. As shown, the flip-flop device is tilted to the right, with the alternative left tilted position indicated in broken lines in FIG. 4 only. The cross-bar of the T of flip-flop device 28 is composed of a central portion 40 desirably formed integrally with the vertical portion 41 of the T, having a central bolt 42 which is fixed in position thereon. Alternatively, of course, the bolt 42 may be fitted into an extended slot 36, either in conjunction with or as a replacement for the retaining pin 26. Various weights 43 may be secured to the crosshead of the T by securing them to the bolt 42.

Adjustably mounted at both ends of the center horizontal T-bar portion 40 are adjustable ears 44, 44. These ears 44 have acutely angled upper tapered surfaces 45, 45, which are angled at less than about 25°–45° to the horizontal, when the upper bar of the T is horizontal. At its inward extremity each such tapered upper surface terminates in a sharply downwardly directed surface 46, arranged at a small acute angle to the vertical.

As shown, each ear 44 is slotted at 50, and adjusting bolts 51, 52 are provided on the member 40 in an arrangement to extend through the slot 50, for adjusting the position of the ear 44 inwardly and outwardly with respect to the vertical center of the flip-flop device 28. Further, as shown in the drawings, large holes 53 may be drilled into each of the ears 44, in order to remove weight at this location, and to concentrate the weight at or in the vicinity of the vertical center line of the flip-flop device 28, substantially along the vertical bar of the T. The substantially vertical surfaces 46, 46, combined with the acutely angled natures of the inclined upper surfaces 45, 45, coact with the adjustable nature of the independently adjustable ears 44, 44, as will further appear in detail hereinafter.

Figure 7:
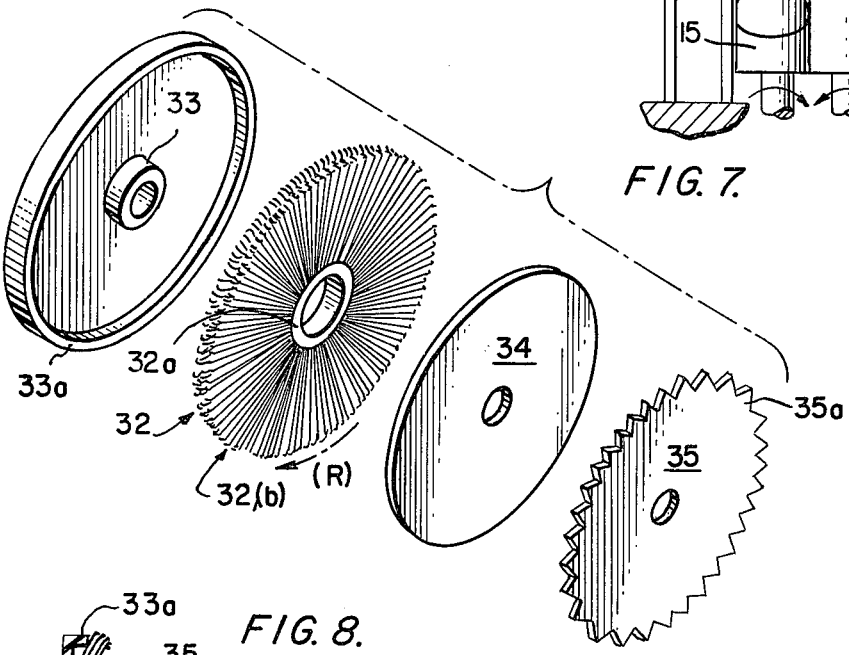
FIG. 7 is an exploded view showing the individual components of a bristle-type strand catching and wrapping device comprising an important feature of this invention.
Figure 8:
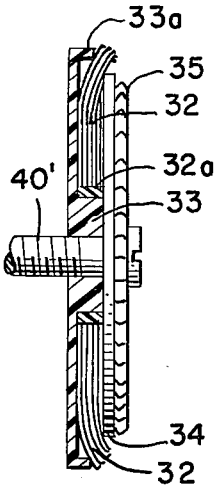
FIG. 8 is an end elevation of the assembled and operative device of FIG. 7.

FIGS. 6, 7 and 8 show strand pickup devices 31(*a*) and 31(*b*) including a circular brush formed of a multiplicity of relatively stiff bristles. The devices 31(*a*) and 31(*b*) are secured, respectively, to the end of spindle 20(*a*) and to the opposing end of spindle 20(*b*) as shown in FIG. 6, and shown individually in FIGS. 7 and 8. Each such device is essentially a disc, supporting a plurality of generally radially-directed bristles 32, which may be ordinary wire bristles such as those in a circular brush. Preferably, however, the bristles are buffed or abraded at their ends in order to form burrs or hooks 32(*b*) as shown in FIG. 7. The bristles 32 may be formed of steel or other metallic wire, or of suitable polymers or other materials. When burred or hooked, the burrs or hooks 32(*b*) are preferably faced in the direction of rotation of the brush, (which is the same as that of the bobbin) as indicated by the arrow (R) in FIG. 7. It will be understood that strand 10 is engaged, caught and anchored by the ends of the bristles 32 during lateral transfer, as will be described further hereinafter.

As shown in FIG. 7, the number 33 designates a hub for centering the brush, which hub 33 has a relatively small central opening and relatively large outer diameter. As shown, the brush comprises a multiplicity of generally radially arranged wire bristles; such bristles may desirably be in the form of plastic bristles or hooks, or the equivalent, as stated. The bristles are secured to an inner ring 32(*a*), of a proper size to fit snugly over the outer cylindrical portion of the hub 33, and within the confining outer rim 33(*a*) thereof. The number 34 in FIG. 7 designates a disc which is of smaller diameter than the effective diameter of the bristles 32, and which is intended to be fitted against the bristles 32 and to press them axially toward to hub 33 to maintain them in position within the hub 33. The number 35 designates a disc having a saw-toothed edge 35(*a*), having a diameter slightly smaller than that of the disc 34, and tightly positioned against a corresponding surface of the disc 34. As will become apparent hereinafter, the saw-tooth disc 35 assists in assuring the cutting of the strand during transfer.

All of the members 32, 33, 34 and 35 of FIG. 7 are secured to each other and to the spindle (not shown) which drives the bobbin by a threaded bolt 40′ appearing in FIG. 8.

Turning now to FIG. 8, the construction of the parts shown in FIG. 7 will now be apparent. The hub 33 is provided for centering on the bolt 40 the ring 32(*a*) of the brush composed of generally radially extending bristles 32. The overhang of the cylindrical cup-shaped rim 33(*a*) prevents the transferring strand from being caught behind the bristles 32 during the transfer operation. Further, disc 34 is of smaller diameter than the bristles, allowing the bristles to flare out in a generally angular direction (away from rim 33(*a*) and toward disc 34), to catch and trap the strand during the transfer operation. As stated, the saw-toothed disc 35 is positioned against the disc 34, and is instrumental in cutting or severing the strand after it has been caught and anchored by the bristles 32.

It will now be apparent that the assembled structure as shown in FIG. 8 is positioned by means of the bolt 40′ extending through the central holes therein, and screwed into the usual tapped opening (not shown) in the end of the corresponding spindle. The brush structures are applied at the ends of both spindles 20(*a*), 20(*b*), as shown in FIG. 6, and each such structure rotates with, and at the same speed as, each of the respective spindles 20(*a*) and 20(*b*).

OPERATION

Figure 9:
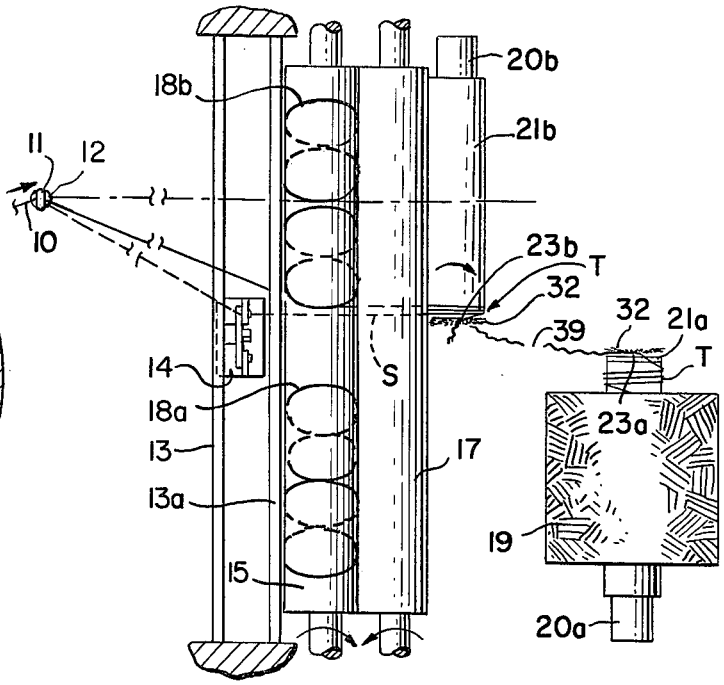
FIG. 9 is a plan view similar to FIG. 1 but taken just after transfer of the strand from a full package to an empty spindle.
Figure 10:
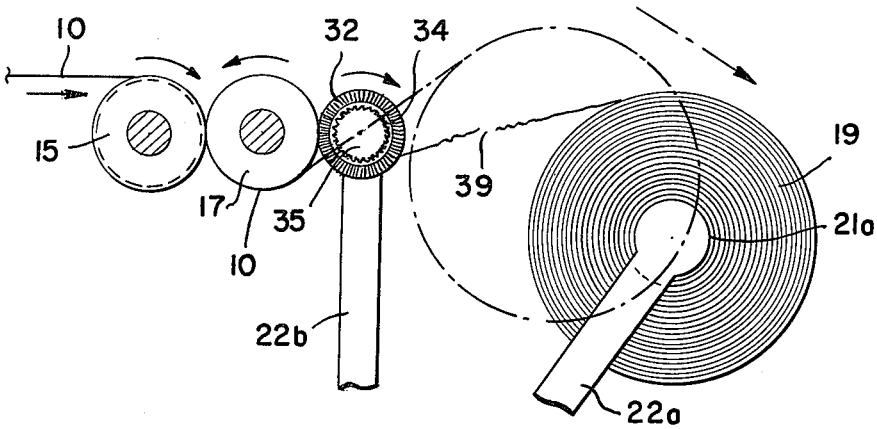
FIG. 10 is an enlarged left side elevation corresponding to FIG. 9.

FIGS. 9 and 10 show the apparatus and strand in views similar to FIGS. 1 and 2, but just after transfer from full package 19 wound on bobbin 21(*a*) and before completion of transfer to empty bobbin 21(*b*). With empty bobbin 21(*b*) in surface contact with rotating intermediate roll 17, eye guide 11 is moved from its position on an extended lateral bisector of package 19 (FIG. 1) on bobbin 21(*a*) to a new position on a similarly extended lateral bisector (dot-dashed line) of bobbin 21(*b*). The laterally moving strand slides lengthwise along guide bars 13 and 13(*a*) while maintained by the winder motor under tension over guide bar 13 and under guide bar 13(*a*), encountering flip-flop device 28, which causes a yarn transfer delay, as will now be apparent.

During this delay, continued yarn winding brings the yarn into contact with the bristles 32 of the yarn catching device 23(*b*) on the adjacent end of spindle 20(*b*), which is being positively driven by its winder motor in the usual manner. At this time, the bulk of the package 19 helps to shield the yarn from engaging the bristles 32 on package spindle 20(*a*). The controlled lateral delay attributable to the flip-flop device 28 provides a semi-slack condition in the strand, causing the strand to be caught momentarily and anchored by the bristles 32 and then formed into a transfer tail of predetermined length at a precisely determined position on the bobbin 21(*b*), spaced slightly from the bristles 32 and from the end of the bobbin 21(*b*).

In being moved by the guide 11, strand 10 encounters the flip-flop device 28 of inertial delay device 14, which temporarily delays the lateral transfer for a predeterminable and controllably adjustable delay period, and positions the strand in accurate alignment with a predetermined marginal position on the empty bobbin 21(*b*), (as indicated by the broken line S in FIG. 9), forming a transfer tail T (FIGS. 6, 9, 11) which is of ideal length and position on the bobbin for the subsequent magazining operation. In doing this, the strand which slides along the periphery of the intermediate roll 17 climbs from its position in which it is caught upon the periphery of the bristles 32 and moves over the end of the empty bobbin 21(*b*) onto the aforesaid predetermined marginal portion of the empty bobbin 21(*b*) which corresponds to the position of the delaying surface 46 of the flip-flop device 28, all the while being supplied thereto from the surface of the immediately adjacent intermediate roll 17 (FIGS. 2 and 9). The windings T on the bobbin comprise the tail and the portion caught by the bristles may be cut off and discarded as waste, if desired.

Subsequently, after the guide 11 has moved to its new centered position opposite empty bobbin 21(*b*), the strand disengages from the delaying surface 46 of flip-flop device 28 because of the tilted angle of surface 46 (FIG. 4) and moves to the position shown in solid lines in FIG. 9. The transferred strand then falls into the slot of traverse roll 15 and is traversed to and fro thereby along the surface of the empty bobbin 21(*b*) to begin the formation of a new package thereon.

In the operation of the present invention, the disc 35 would tend to sever the strand 10 after the strand has been transferred to the bobbin 21(*b*). This is accomplished since the disc 35 of the bobbin 21(*b*) is of course rotating along with the bobbin and the strand which extends between the two bobbins 21(*a*) and 21(*b*) will naturally fall over one of the cutting edges of disc 35 and be severed. Further, as the operator removes the full package, the swing arm 22*a* in swinging away causes the taut strand between package 19 and bristles 32 to fall over a cutting edge of the disc 35 which will immediately sever this strand because of the continued rotation and/or swinging away of the full package 19.

Swing arm 22(*a*) mounting the full package spindle is then swung outwardly, usually by the machine operator or tender, to lift the package away from the rotating intermediate roll to the position shown in FIG. 9. If not previously cut by cutter disc 35, the strand tautens between package 19 and bristles 32 because of the continued rotation and/or the swinging away of the full package 19 to such an extent that breakage is caused, as indicated at 39. Usually the severing device 35 functions to cut the strand before any breakage occurs at the indicated break location 39. The full package can easily be doffed after cutting or breakage, and an empty bobbin substituted. Of course, when the building package becomes full, the strand is transferred laterally back to its initial position, thereby starting a new package on the empty bobbin substituted there.

Referring to FIG. 4, and assuming that the strand is being transferred from right to left, and that the flip-flop device is initially tilted to the position shown in solid lines (the "in-phase" position), the operation of the novel delay means will further become apparent. In the transfer of the strand from right to left, the strand passes over the central cross-bar portion 40 of the T, and abruptly contacts the substantially vertical surface 46 at the left-hand portion of FIG. 4. This surface 46, as has heretofore been described, may be adjustably positioned and is a part of an adjustably positionable ear 44. Thus, by properly adjusting the ear 44 inwardly and outwardly, the substantially vertical surface 46 can be aligned relative to the desired portion of the marginal portion of the end of the bobbin upon which the transfer tail is intended to be wrapped. The position of ear 44 has surprisingly been found to vary, depending upon the specific factors present in the dynamic situation encountered at the split second of tail formation. Such factors include yarn tension and denier, transfer speed, spacing between yarn guide, flip-flop and bobbin and others. An examination of FIG. 9, with particular reference to the dotted line S indicating the strand path at this point, shows how the delay of yarn transfer may be effected in precise alignment with a selected marginal portion of the end of the bobbin, whereupon a considerable delay is effected at precisely the time and place that it is necessary to make such a delay, in order to wrap a tail of predetermined length around the periphery of the end of the bobbin. Due to inertia of the yarn, as opposed by the adjustable weights 43, 30 heretofore described, the flip-flop device 28 is tilted toward the dot-dash position shown in FIG. 4, permitting the strand S to travel upwardly along the left-hand surface 46, and to drop down into the groove 18b of the traverse roll 15.

It will be appreciated that the delay timing of the flip-flop device 28 may be adjusted by varying the amounts of the weights 43 bolted to the non-adjustable center bolt 42. This varies the inertia of the flip-flop device and such variation is accurately proportional to the length of the transfer tail that is formed at the margin of the bobbin.

It is of particular advantage to provide a brush composed of a plurality of bristles 32 for catching and anchoring the transfer strand. It is of further advantage to provide the combination of the novel form of flip-flop device 28 with the use of the bristles 32, and particularly to provide the adjustable ears 44 on the flip-flop device, for precise alignment of the strand path with the position near the end of the bobbin 21(*b*) at the crucial moment of time delay, and to provide adjustable means for predetermining the length of the tail. In this connection, there is further advantage in the construction of the bristles device, wherein the overhang 33*a* prevents the yarn from being caught behind the bristles (and thereafter wrapped). Also, the construction wherein the smaller diameter disc 34 is provided to cause the bristles to flare outwardly in a partially axial direction with respect to the bobbin, sufficiently to cause capture without wrapping, is highly advantageous. Still further advantages are realized in the extra protection provided by the saw-tooth disc 35, which assures cutting even if breakage should not be achieved by other means.

It is highly advantageous to provide the inclined surfaces 45, 45 at an angle of less than about 45° to the horizontal. If the flip-flop device 28 should accidentally be positioned out of phase with the strand movement (for example, in the dash line position in FIG. 4 when the strand is being transferred from right to left) the strand will nevertheless contact the right-hand inclined surface 45, recock the flip-flop device to the in-phase position by contacting the inclined surface 45, and then perform the delay function by contacting the left-hand substantially vertical surface 46. The guide bar 13(*a*), which coacts with guide bar 13, limits upward movement of the strand and keeps the strand against the upper surface 45 to perform the re-cocking operation. This occurs almost instantaneously before the delay function of the surface 46 is carried into effect. This is an important and advantageous feature of the invention.

It will now be appreciated that this invention provides a simple, yarn-actuated tailing device, which is adjustable to control the position of the tail along the bobbin, which acts positively to catch the yarn and to form the tail, and which can control the length of the tail within desirable limits. Further, the device is adjustable to control yarns of widely varying deniers. Additionally, controlled cutting is provided for the yarn as a part of the transfer operation.

Although a preferred embodiment has been illustrated and described, modifications may be made therein, as by adding, combining, or subdividing parts or steps, or substituting equivalents, while retaining significant advantages and benefits of the invention, which itself is defined in the following claims.

The following is claimed:

1. In an apparatus for delaying the transfer of a textile strand from a first package for winding said strand onto a second package spaced endwise therefrom, said apparatus including a delay means having passive and active delay positions and comprising a generally T-shaped device having a base leg and an upper cross bar, said base leg being for limited tilting movement from side to side, said active position tilted to engage said strand from said first package and allowing movement along said upper cross bar causing tilting by said strand thereof to a delay position and allowing strand to transfer onto second package, and said passive position not engaging said strand and comprising means including a recocking surface arranged at an angle to contact said strand and to recock said delay device from said passive to said active delay position under the influence of said strand, said tilting to said delay position causing delay of said strand during the strand transfer operation.

2. Apparatus according to claim 1 in combination with means adjacent said delay device for exerting downwardly directed force upon said strand to urge said strand downwardly upon said recocking surface.

3. In an apparatus for engaging and gripping a transfer tail of a strand during transfer of the strand from winding onto a first package to winding onto a second package supported on respective spindles spaced endwise from each other comprising a yarn catching means providing a multiplicity of bristles positioned in the vicinity of the adjacent end of the second package, said bristles extending outwardly in a substantially radial manner and providing a plurality of bristle ends including hooking means at their ends and arranged in an arc extending substantially around the periphery of said end of said second package, and shielding means are provided adjacent the ends of said bristles for preventing the strand from being caught in any other manner than in said bristles during said transfer.

4. In an apparatus for engaging and gripping a transfer tail of a strand during transfer of the strand from winding onto a first package to winding onto a second package supported on respective spindles spaced endwise from each other comprising a yarn catching means providing a multiplicity of bristles positioned in the vicinity of the adjacent end of the second package, said bristles extending outwardly in a substantially radial manner and providing a plurality of bristle ends including hooking means at their ends and arranged in an arc extending substantially around the periphery of said end of said second package and means are provided for causing the ends of said bristles to flare outwardly from said second package at least partially toward said first package.

5. An apparatus for winding a textile strand, comprising a first circular spindle for formation of a first package thereon, a second circular spindle spaced endwise from said first spindle for formation of a second package therein, means for transferring said strand from a package on said first spindle to said second spindle, strand transfer delay means positioned to be contacted by the transferring strand to delay the transfer of the strand, a first and second circular brush coaxially disposed to said first and second spindles respectively, said circular brushes each capable of catching the strand at a point along the length of the strand whereby said strand is formed into a transfer tail on the respective spindle and is subsequently formed into said respective package, and first and second circular strand cutting means coaxially disposed with respect to said first and second circular brushes for cutting the strand extending between said spindles.

* * * * *